US005444988A

United States Patent [19]

Eden

[11] Patent Number: 5,444,988

[45] Date of Patent: Aug. 29, 1995

[54] CLOSED LOOP OIL CHARGING FOR AC OR REFRIGERANT COMPRESSOR UNITS

[76] Inventor: Herbert R. Eden, 421 SW. 124 Ave., Miami, Fla. 33184

[21] Appl. No.: 308,552

[22] Filed: Sep. 19, 1994

Related U.S. Application Data

[62] Division of Ser. No. 94,947, Jul. 21, 1993.

[51] Int. Cl.[6] ..... F25B 49/00

[52] U.S. Cl. ..... 62/125; 62/292; 62/468

[58] Field of Search ..... 62/125, 77, 292, 468, 62/470, 473

[56] References Cited

U.S. PATENT DOCUMENTS

| | | | |
|---|---|---|---|
| 2,749,723 | 6/1956 | Webber | 62/470 |
| 3,777,509 | 12/1973 | Muench | 62/470 |
| 5,167,126 | 12/1992 | Cartwright | 62/292 |
| 5,265,432 | 11/1993 | Luepke et al. | 62/84 |

OTHER PUBLICATIONS

Thermal Engineering Catalog, p. 252, Thermal Charg-Oil Pumps & Chang-Oil Pump Publicly available 1993.

ACR Catalog, Publicly available 1993, p. 99. Thermal Charg-Oil Pump, Chang-Oil Pump.

PMI Catalog, p. 178, available 1993, compressor oil pump.

*Primary Examiner*—John M. Sollecito

*Attorney, Agent, or Firm*—Robert C. Kain, Jr.

[57] ABSTRACT

The closed loop oil service system operates in conjunction with an air conditioner or refrigerant compressor lubricated by lubricating oil contained within the compressor casing. The compressor includes a submerged oil drain port, submerged oil view port, a refrigerant inlet port and refrigerant outlet port. The closed loop oil service system utilizes a canister containing compressor lubricating oil and having a long stem first valve and a short stem second valve. Depending on the mode of oil service being performed the system may also incorporate a refrigerant recovery unit, a refrigerant drum or a clear calibrated fluid injection device. The system also includes at least a pair of coupler hoses which fluidly and gaseously connect the canister valves and compressor ports in varying configurations. In one embodiment, a closed loop calibrated oil augmentation system is formed by incorporating a coupler hose and a clear calibrated fluid injection device. A refrigerant drum is coupled to canister second valve and device pressure port to provide motive force for calibrated oil augmentation operations to a non-operating compressor.

4 Claims, 4 Drawing Sheets

CLOSED LOOP OIL CHARGING FOR AC OR REFRIGERANT COMPRESSOR UNITS

This is a divisional of copending application Ser. No. 08/094,947 filed on Jul. 21, 1993.

BACKGROUND OF THE INVENTION

The present invention relates to a closed loop oil service system for AC or refrigerant compressor units. AC and refrigerant systems customarily utilize a compressor to compress a refrigerant such as freon. These compressors operate in a bath of oil contained within the compressor casing. The compressor customarily includes a refrigerant inlet port, a refrigerant outlet port (sometimes referred to as low and high pressure ports or suction and discharge ports), a view port or sight glass, integral to the compressor casing located near the recommended level of the lubricating oil and a submerged oil drain port.

As is common with many mechanical devices, the lubricating oil in the compressor casing may be drained, augmented or replaced during the life span of the compressor. Prior art oil service systems simply utilize an open container to drain or remove a quantity of oil from the compressor casing and a simple, hand actuated, mechanically operated pump inserted into an open container of compressor lubricating oil for injecting a quantity of oil into the compressor casing. These prior art containers are not fluidly or gaseously sealed. These prior art oil service devices are strictly of manual operation and require all motive force, on the oil, to be provided by the operating technician. The compressor oil may be added through the refrigerant inlet port or the oil drain port.

A problem arises with the use of these prior art oil service devices in that when oil is removed from the compressor the refrigerant gases, in solution, are allowed to escape into the environment because these prior art systems are not closed loop systems. Government regulations currently restrict or prohibit the release of certain refrigerant gases into the atmosphere. Prior art oil service system devices do not comply with the current government regulations relating to the release of refrigerant gases into the atmosphere.

OBJECTS OF THE PRESENT INVENTION

It is an object of the present invention to provide both a closed loop compressor oil removal system, and a closed loop compressor oil augmentation system.

It is a further object of the present invention to provide a closed loop compressor oil service system that prohibits the release of refrigerant gas by capturing the same in the closed loop system and/or by returning the refrigerant gas to the compressor system and/or to refrigerant recovery equipment.

It is an additional object of the present invention to provide a closed loop compressor oil service system which can provide an oil quantity reduction system in one mode, and an oil drain system in a second mode.

It is a further object of the present invention to provide a closed loop compressor oil augmentation system which can be utilized to charge a new compressor with oil in one mode and add oil to a currently operating compressor in a second mode, while relieving the operating technician of the need to provide the motive force for these operations.

SUMMARY OF THE INVENTION

The closed loop compressor oil service system operates in conjunction with an AC or refrigerant compressor lubricated by oil in the compressor casing. The compressor includes a submerged oil drain port, a refrigerant inlet port and a refrigerant outlet port. The closed loop compressor oil service system utilizes a fluidly and gaseously sealed canister containing compressor lubricating oil. The canister has a first and second valve, both located at the top of the canister, wherein the first valve has a long stem with a port located near the bottom of the canister submerged below the level of the oil within the canister and the second valve having a short stem with a port located near the top of the canister above the oil level within the canister. The canister also incorporates an opening located at the top of the canister. This opening is used to fill and empty the canister, pre and post compressor oil service operations. A plug type, lever lock seal is used to seal this opening during compressor oil service operations. Integral to this plug type, lever lock seal is a pressure relief valve to permit venting of the canister should an over-pressure situation occur. The system also includes, at least, a pair of coupler hoses which may be used to connect the first and second valves of the canister with either the compressor oil drain port, the compressor refrigerant inlet port, the compressor refrigerant outlet port or refrigerant recovery equipment.

In one embodiment, with an operating compressor system, a closed loop oil removal system is formed by connecting a first coupler hose to the compressor oil drain port and the first valve of the canister and a second coupler hose to the refrigerant inlet port of the compressor and the second valve of the canister. A closed fluid loop is established between the compressor oil drain port and the first valve of the canister via the first coupler hose. A closed gaseous loop is established between the refrigerant inlet port of the compressor and the second valve of the canister via the second coupler hose. The internal pressure, within the compressor, provides the motive force to push the compressor oil into the canister. A lower pressure is maintained within the canister, to expedite the oil removal/drain, via the canister's coupling to the compressor refrigerant inlet port.

With a non-operating compressor system, a closed loop oil removal system is formed by connecting a first coupler hose to the compressor oil drain port and the first valve of the canister and a second coupler hose from the second valve of the canister to refrigerant recovery equipment and a third coupler hose from the refrigerant recovery equipment to the refrigerant inlet port of the compressor. A closed fluid loop is established between the compressor oil drain port and the first valve of the canister via the first coupler hose. A closed gaseous loop is established between the second valve of the canister and the refrigerant inlet port of the compressor via the second coupler hose, refrigerant recovery equipment and the third coupler hose respectively. The internal pressure, within the compressor, provides the motive force to push the compressor oil into the canister. A lower pressure is maintained within the canister, to expedite the oil removal/drain, via the canister's coupling to refrigerant recovery equipment.

In a second embodiment, with an operating compressor system, a closed loop compressor oil augmentation system is formed, which alleviates the need for the operating technician to supply motive force, by connecting the compressor refrigerant outlet port to the second valve of the canister via the first coupler hose and connecting either the compressor oil drain port or the compressor refrigerant inlet port to the first valve of the canister via the second coupler hose. A closed gaseous loop is established between the compressor refrigerant outlet port and the second valve of the canister via the first coupler hose and a closed fluid loop is established between either the compressor oil drain port and the first valve of the canister or between the compressor refrigerant inlet port and the first valve of the canister via the second coupler hose. Refrigerant gas pressure from the compressor refrigerant outlet port provides the motive force to inject additional compressor oil from the canister into either the compressor oil drain port or the compressor refrigerant inlet port.

With a non-operating or new compressor system a closed loop compressor oil augmentation system is formed, which alleviates the need for the operating technician to supply motive force, by connecting a refrigerant drum to the second valve of the canister via the first coupler hose and connecting the compressor oil drain port to the first valve of the canister via the second coupler hose. A closed gaseous loop is established between the refrigerant drum and the second valve of the canister via the first coupler hose and a closed fluid loop is established between the compressor oil drain port and the first valve of the canister via the second coupler hose. Refrigerant gas pressure from the refrigerant drum provides the motive force to inject additional compressor oil from the canister into the compressor casing.

BRIEF DESCRIPTION OF THE DRAWINGS

Further objects and advantages of the present invention can be found in the "Detailed description of the preferred embodiments when taken in conjunction with the accompanying drawings in which.

DETAILED DESCRIPTION OF PREFERRED EMBODIMENTS

The present invention relates to a closed loop oil service system used in conjunction with an AC or refrigerant compressor.

Figure 1:
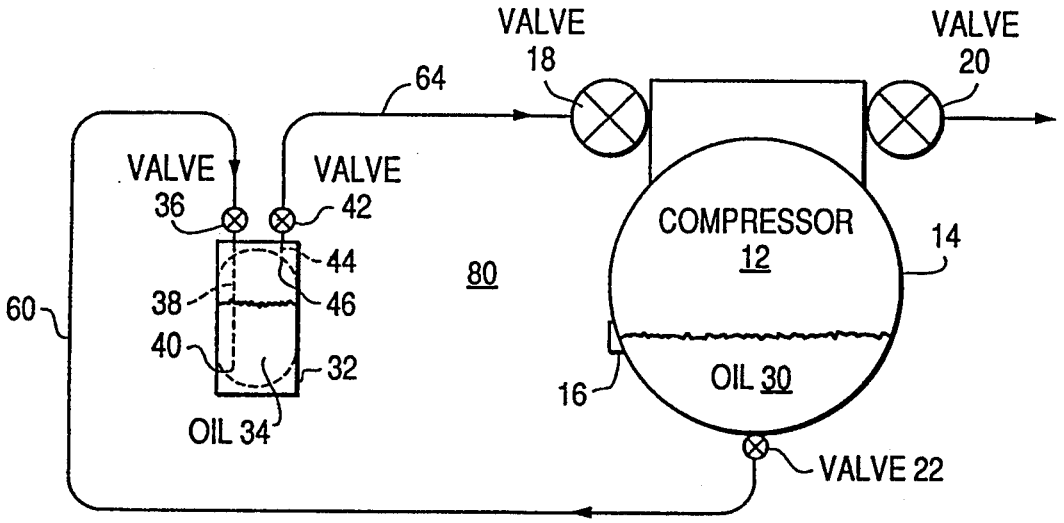
FIG. 1 diagrammatically illustrates a closed loop oil removal system used to recover oil from an operating AC or refrigerant compressor casing.
Figure 2:
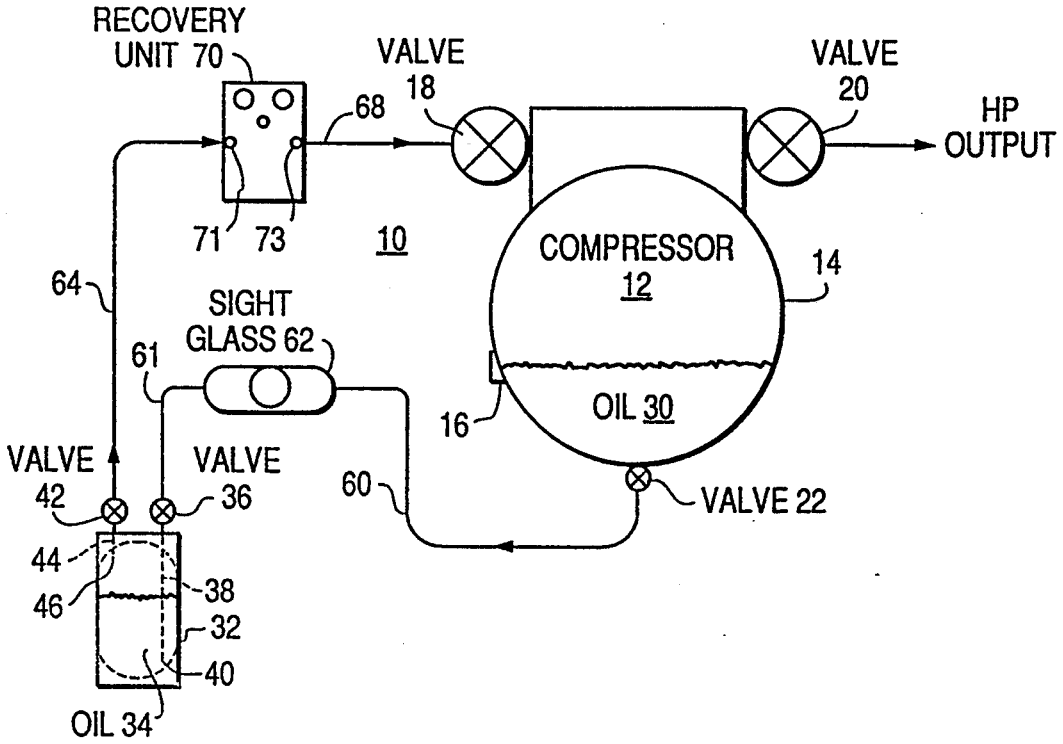
FIG. 2 diagrammatically illustrates a closed loop oil removal system used to recover oil from a non-operating AC or refrigerant compressor casing.

FIGS. 1 and 2 diagrammatically illustrate a closed loop oil removal system.

Figure 3:
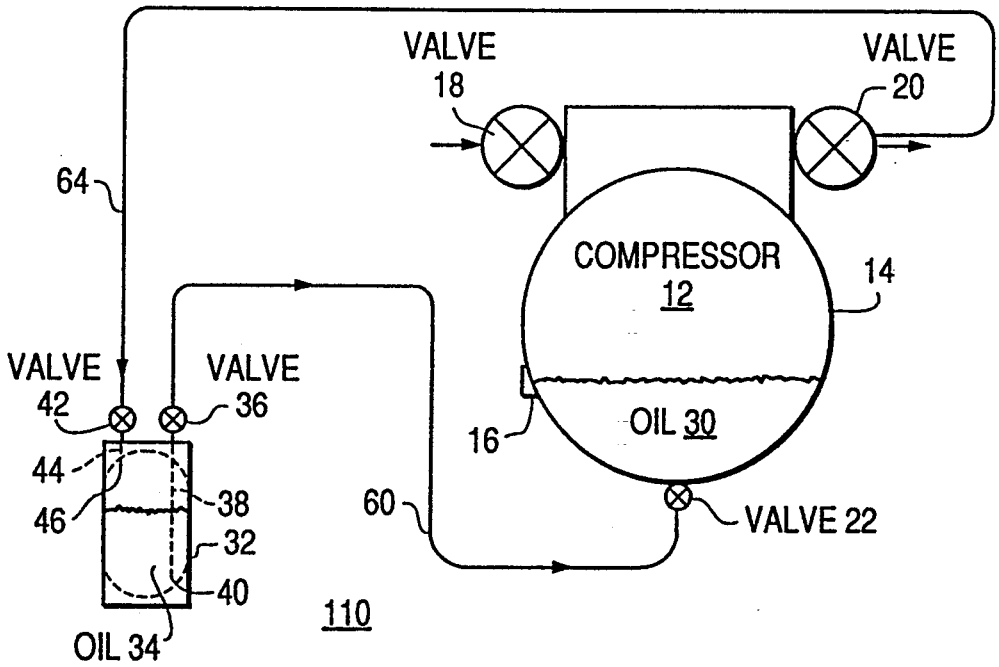
FIG. 3 diagrammatically illustrates a closed loop oil augmentation system used to augment oil quantity of an operating AC or refrigerant compressor casing with integral sight glass.
Figure 4:
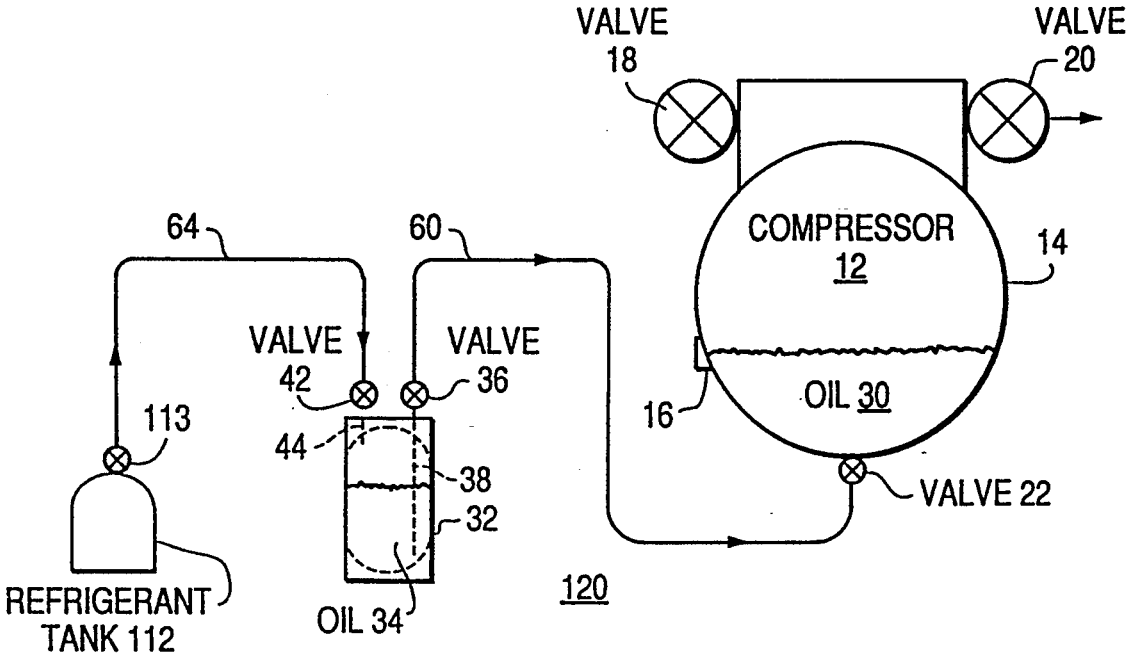
FIG. 4 diagrammatically illustrates a closed loop oil augmentation system used to augment oil quantity of a non-operating AC or refrigerant compressor casing with integral sight glass.

FIGS. 3 and 4 diagrammatically illustrate a closed loop oil augmentation system.

Figure 5:
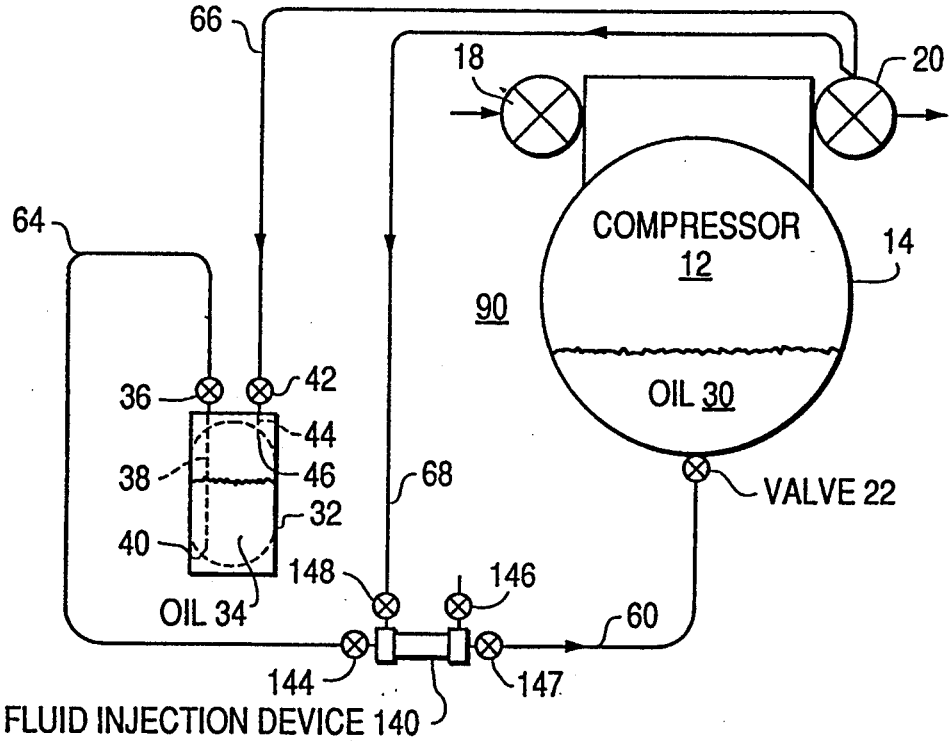
FIG. 5 diagrammatically illustrates a closed loop calibrated oil augmentation system used to augment an operating AC or refrigerant compressor without a integral sight glass.
Figure 6:
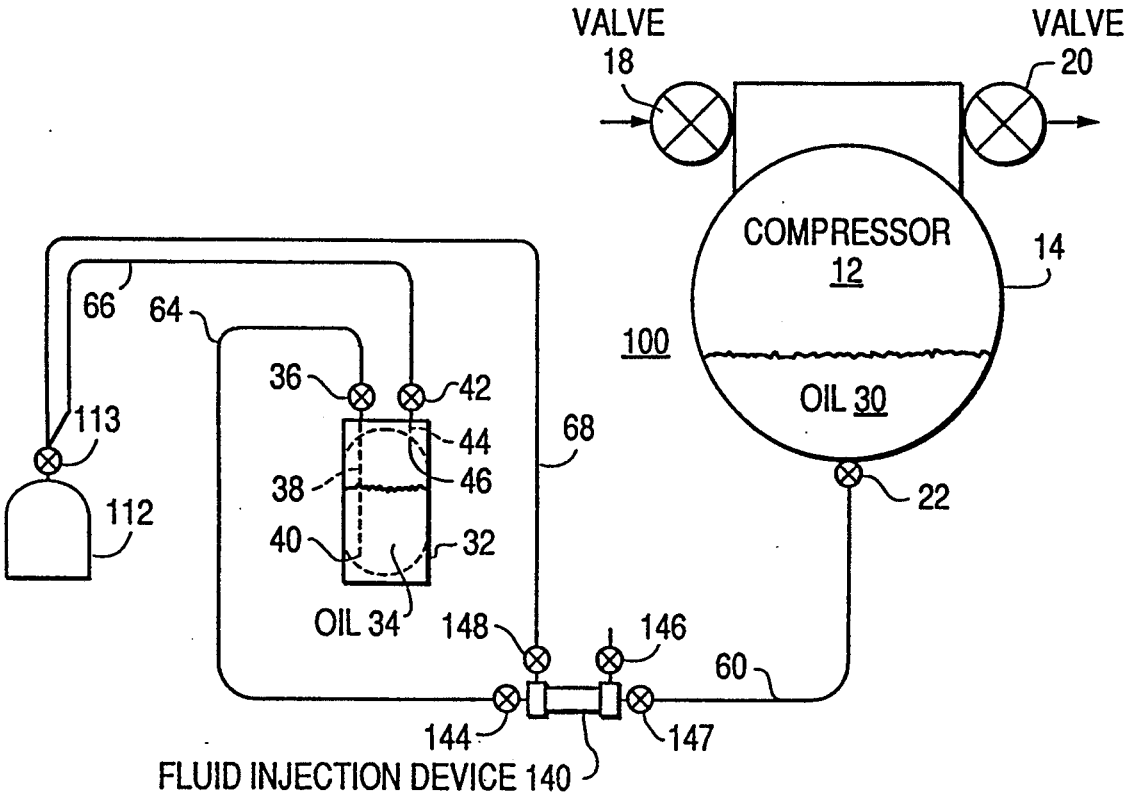
FIG. 6 diagrammatically illustrates a closed loop calibrated oil augmentation system used to augment a non-operating AC or refrigerant compressor without a integral sight glass.

FIGS. 5 and 6 diagrammatically illustrate a closed loop calibrated oil augmentation system.

Figure 7:
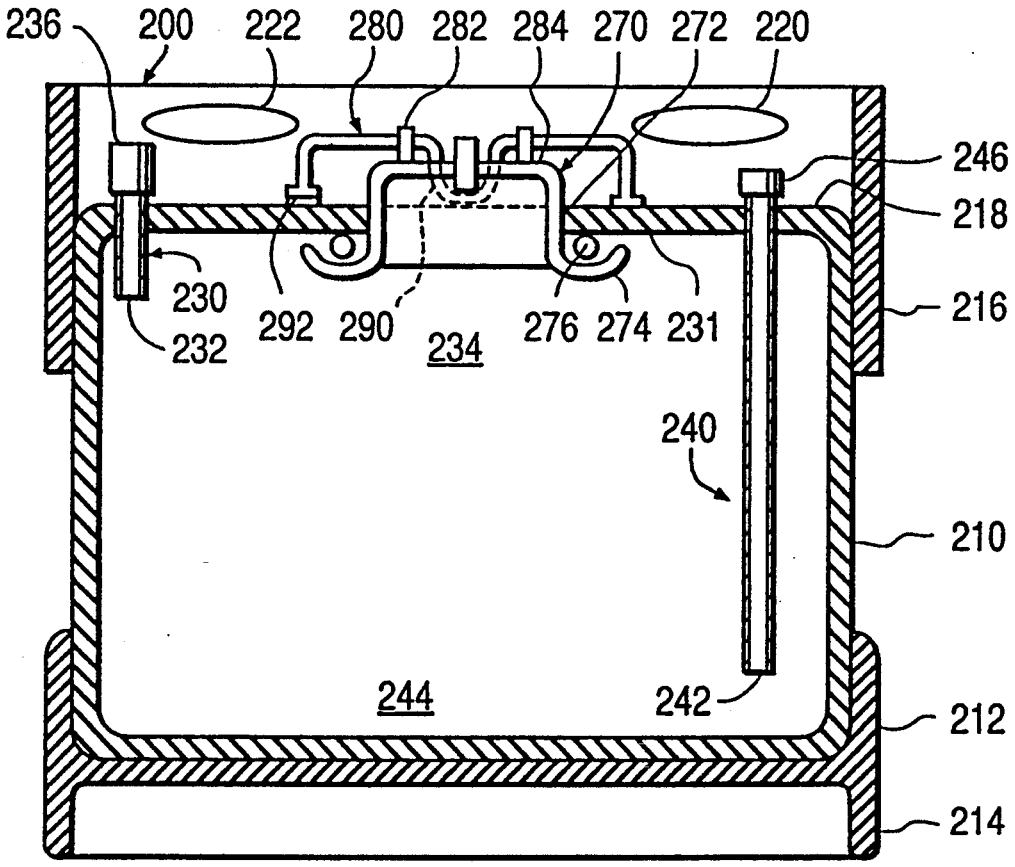
FIG. 7 diagrammatically illustrates a canister which may be used to contain the lubricating oil.
Figure 8:
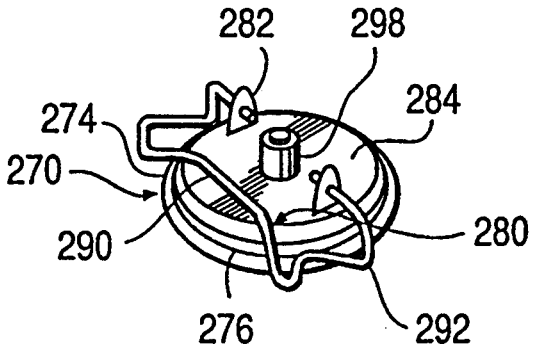
FIG. 8 illustrates a perspective view of the cap for the canister.

FIGS. 7 and 8 diagrammatically illustrate a cross-sectional view of one type of canister and a cap, respectively.

Similar numerals designate similar items throughout all figures.

FIG. 1 diagrammatically illustrates closed loop oil removal system 80 for recovering compressor lubricating oil 30 from operating compressor 12. Operating compressor 12 includes compressor casing 14, sight glass or viewing port 16, refrigerant inlet port and valve 18, refrigerant outlet port and valve 20 and submerged oil drain port and valve 22. Operating compressor 12 is illustrated as retaining a supply of lubricating oil 30 within compressor casing 14. Closed loop oil removal system 80 includes fluidly and gaseously sealed canister 32 and first valve 36 having long stem 38 and port 40 located near the bottom of canister 32. Canister 32 also includes second valve 42 having short stem 44 with port 46 located near the top of the canister. Closed loop oil removal system 80 includes first and second coupler hose 60 and 64. First coupler hose 60 fluidly connects compressor oil drain port valve 22 of AC or refrigerant compressor 12 with long stem first valve 36 of canister 32. Second coupler hose 64 gaseously connects short stem valve 42 to refrigerant inlet valve 18 of compressor 12.

In operation, the operating technician connects canister 32, operating compressor 12 and first and second coupler hoses 60 and 64 in a fluidly and gaseously sealed manner as disclosed above. By opening refrigerant inlet valve 18, canister short stem second valve 42, long stem first valve 36, and oil drain port valve 22, compressor oil 30 is pushed into canister 32 by refrigerant gas pressure within compressor casing 14. A lower pressure is maintained within canister 32 via second coupler hose 64. The operating technician monitors the amount of oil removed from compressor casing 14 by monitoring compressor sight glass 16. When the appropriate oil level is established within compressor casing 14 the oil removal operation is concluded by closing the valves previously opened to facilitate the oil removal operations.

It is important to note that closed loop oil removal system 80 is not only a closed fluid loop system but also a closed refrigerant gas loop system by virtue of the containment of the same within the system.

FIG. 2 diagrammatically illustrates closed loop oil removal system 10 for recovering compressor lubricating oil 30 from non-operating compressor 12. Closed loop oil removal system 10 for non-operating compressor 12 incorporates refrigerant recovery unit 70 to maintain the higher pressure within the non-operating compressor casing 14 and the lower pressure within canister 32. Refrigerant recovery unit 70 is comprised of a small AC or refrigerant compressor powered by an available electrical source. Its operational characteristics are the same as those of the compressor being serviced. Inlet and outlet pressure gauges, to monitor corresponding pressures, are integral with the refrigerant recovery unit 70. Closed loop oil removal system 10 for a non-operating compressor also incorporates additional sight glass 62 in line 60 to indicate completion of the oil removal operations. Non-operating compressor 12 includes compressor casing 14, sight glass or viewing port 16, refrigerant inlet port and valve 18, refrigerant outlet port and valve 20 (the high pressure port) and submerged oil drain port and valve 22. Non-operating compressor 12 is illustrated as retaining a supply of lubricating oil 30 within compressor casing 14. Closed loop oil removal system 10 includes fluidly and gaseously sealed canister 32 and first valve 36 having long stem 38 and port 40 located near the bottom of canister 32. Canister 32 also includes second valve 42 having short stem 44 with port 46 located near the top of the canister. Closed loop oil removal system 10 includes four coupler hoses 60, 61, 64, and 68. First coupler hose 60 fluidly connects compressor oil drain port valve 22 of non-operating compressor 12 to sight glass 62. Second coupler hose 61 fluidly connects sight glass 62 to long stem valve 36 of canister 32. Third and fourth coupler hoses 64 and 68 gaseously connect short stem valve 42 of canister 32 and refrigerant inlet port 18 via serially connected refrigerant recovery unit 70.

In operation, the operating technician connects canister 32, refrigerant recovery unit 70, non-operating compressor 12 and first, second, third and fourth coupler hoses 60, 61, 64 and 68 in a fluidly and gaseously sealed manner as disclosed above and switches ON refrigerant recovery unit 70. By opening refrigerant inlet valve 18, refrigerant recovery unit valves 71 and 73, canister second or short stem valve 42, canister first or long stem valve 36, and oil drain port valve 22, compressor oil 30 is pushed into canister 32 by refrigerant gas pressure within compressor casing 14 supplied by refrigerant recovery unit 70. A lower pressure is maintained within canister 32 via refrigerant recovery unit 70 and third coupler hose 64. The operating technician monitors the amount of oil removed from non-operating compressor casing 14 by monitoring the oil level in compressor sight glass 16. When the level of oil visually presented in compressor oil sight glass 16 and further viewed in serially coupled sight glass 62 indicate the absence of oil, the oil removal operation is concluded by closing the valves previously opened to facilitate the oil removal operations and switching OFF refrigerant recovery unit 70.

It is important to note that closed loop oil removal system 10 is not only a closed fluid loop system but also a closed refrigerant gas loop system by virtue of the containment of the same within the system.

FIG. 3 diagrammatically illustrates closed loop oil augmentation system 110 for injecting compressor lubricating oil 34 from canister 32 into compressor casing 14 of operating compressor 12. Operating compressor 12 includes compressor casing 14, sight glass or viewing port 16, refrigerant inlet port and valve 18, refrigerant outlet port and valve 20 and submerged oil drain port and valve 22. Closed loop oil augmentation system 110 includes fluidly and gaseously sealed canister 32 and first valve 36 having long stem 38 and port 40 located near the bottom of canister 32. Canister 32 also includes second valve 42 having short stem 44 with port 46 located near the top of the canister. Canister 32 is illustrated as having a supply of lubricating oil 34. Closed loop oil augmentation system 110 includes first and second coupler hoses 60 and 64. First coupler hose 60 fluidly connects compressor oil drain port valve 22 of operating compressor 12 with long stem first valve 36 of canister 32. Second coupler hose 64 gaseously connects short stem valve 42 to refrigerant outlet valve 20 of operating compressor 12.

In operation, the operating technician connects canister 32, operating compressor 12 and first and second coupler hoses 60 and 64 in a fluidly and gaseously sealed manner as disclosed above. By opening refrigerant outlet valve 20, canister second short stem valve 42, canister first long stem valve 36, and oil drain port valve 22 lubricating oil 34 is pushed into operating compressor 12 via coupler hose 60. High pressure refrigerant gas from refrigerant outlet valve 20 via coupler hose 64 pushes the lubricating oil into compressor casing 14. The operating technician monitors the amount of oil injected into compressor casing 14 by monitoring compressor sight glass 16. When the appropriate oil level is established within compressor casing 14 based upon the view through compressor sight glass 16, the oil augmentation operation is concluded by closing the valves previously opened to facilitate the oil augmentation operations.

It is important to note that closed loop oil augmentation system 110 is not only a closed fluid loop system but also a closed refrigerant gas loop system by virtue of the containment of the same within the system.

FIG. 4 diagrammatically illustrates closed loop oil augmentation system 120 for injecting compressor lubricating oil 34 into non-operating compressor 12. Closed loop oil augmentation system 120 for non-operating compressor 12 incorporates a drum or tank of refrigerant 112 with valve 113 to supply pressure to canister 32 to force compressor lubricating oil 34 into compressor casing 14. Non-operating compressor 12 includes compressor casing 14, sight glass or viewing port 16, refrigerant inlet port and valve 18, refrigerant outlet port and valve 20 and submerged oil drain port and valve 22. Closed loop oil augmentation system 120 includes fluidly and gaseously sealed canister 32 and first valve 36 having long stem 38 and deep port 40 located near the bottom of canister 32. Canister 32 also includes second valve 42 having short stem 44 with upper port 46 located near the top of canister 32. Canister 32 is illustrated as having a supply of lubricating oil 34. Closed loop oil augmentation system 120 includes first and second coupler hoses 60 and 64. First coupler hose 60 fluidly connects compressor oil drain port valve 22 of non-operating compressor 12 with long stem valve 36 of canister 32. Second coupler hose 64 gaseously connects short stem valve 42 to refrigerant drum or tank valve 113.

In operation, the operating technician connects canister 32, refrigerant drum 112, compressor oil drain port valve 22 and first and second coupler hoses 60 and 64 in a fluidly and gaseously sealed manner as disclosed above. Pressure to push lubricating oil 34 from canister 32 is provided by the gas in refrigerant drum 112 via coupler hose 64. By opening refrigerant drum valve 113, canister second short stem valve 42, canister first long stem valve 36, and compressor oil drain port valve 22, lubricating oil 34 is pushed into compressor casing 14 by the higher pressure acting on the surface of oil 34. The operating technician monitors the amount of oil injected into compressor casing 14 by monitoring the view from compressor sight glass 16. When the appropriate oil level is established within compressor casing 14, the oil augmentation operation is concluded by closing the valves previously opened to facilitate the oil augmentation operations.

It is important to note that closed loop oil augmentation system 82 is not only a closed fluid loop system but also a closed refrigerant gas loop system by virtue of the containment of the same within the system.

FIG. 5 diagrammatically illustrates closed loop calibrated oil augmentation system 90 for injecting a calibrated amount of lubricating oil into operating compressor casing 14. The system illustrated in FIG. 5 is preferably used when compressor 12 does not include an integral oil view port. Operating compressor 12 includes compressor casing 14, refrigerant inlet port and valve 18, refrigerant outlet port and valve 20 and submerged oil drain port and valve 22. Closed loop calibrated oil augmentation system 90 for operating compressor 12 incorporates clear calibrated fluid injection device 140 with inlet port and valve 144, outlet port and valve 147, vent port and valve 146 and pressure port and valve 148. Device 140 may be a Spectroline Mist Infuser which is covered by U.S. Pat. No. 4,938,063. Closed loop calibrated oil augmentation system 90 includes fluidly and gaseously sealed canister 32 and first valve 36 having long stem 38 and port 40 located near the bottom of canister 32. Canister 32 also includes second valve 42 having short stem 44 with port 46 located near the top of canister 32. Canister 32 is illustrated as having a supply of lubricating oil 34. Closed loop calibrated oil augmentation system 90 includes four coupler hoses 60, 64, 66 and 68. First and second coupler hoses 60 and 64 fluidly connect compressor oil drain port valve 22 of operating compressor 12 with long stem first valve 36 of canister 32 via clear calibrated fluid injection device 140. Third and fourth coupler hoses 66 and 68 gaseously connect refrigerant outlet port valve 20 of operating compressor 12 with short stem valve 42 of canister 32 and pressure port valve 148 of clear calibrated fluid injection device 140.

In operation, the operating technician connects canister 32, operating compressor 12, clear calibrated fluid injection device 140 and first, second, third and fourth coupler hoses 60, 64, 66 and 68 in a fluidly and gaseously sealed manner as disclosed above. By opening refrigerant outlet valve 20, and canister second short stem valve 42, pressure is supplied to the interior of canister 32 via coupler hose 66. Then by opening canister first long stem valve 36, clear calibrated fluid injection device inlet valve 144 and vent valve 146, the clear calibrated fluid injection device will begin to fill with lubricating oil 34 due to the pressure acting on the surface of oil 34 and provided to canister 32 via coupler hose 66 from refrigerant outlet valve 20. When the appropriate amount of lubricating oil is contained in or captured by the clear calibrated fluid injection device, the operating technician closes canister first valve 36 and clear calibrated fluid injection device inlet valve 144 and vent valve 146. Fluid injection device 140 may include a calibrated sight glass to measure the oil captured thereby. The operating technician then opens the clear calibrated fluid injection device pressure valve 148, outlet valve 147 and compressor oil drain valve 22. Refrigerant outlet valve 20 then supplies pressure via coupler hose 68 to clear calibrated fluid injection device 140 to force the lubricating oil into compressor casing 14. When the appropriate amount of lubricating oil has been injected into compressor casing 14, the calibrated oil augmentation service is terminated and the appropriate valves are closed.

It is important to note that calibrated closed loop oil augmentation system 90 is not only a closed fluid loop system but also a closed refrigerant gas loop system by virtue of the containment of the same within the system.

FIG. 6 diagrammatically illustrates closed loop calibrated oil augmentation system 100 for injecting a calibrated amount of lubricating oil into non-operating compressor casing 14. Preferably, The system in FIG. 6 does not include an integral oil view port. Non-operating compressor 12 includes compressor casing 14, refrigerant inlet port and valve 18, refrigerant outlet port and valve 20 and submerged oil drain port and valve 22. Closed loop calibrated oil augmentation system 100 for a non-operating compressor incorporates clear calibrated fluid injection device 140 with inlet port and valve 144, outlet port and valve 147, vent port and valve 146 and pressure port and valve 148. System also includes, refrigerant drum or tank 112 and valve 113. Closed loop calibrated oil augmentation system 100 includes fluidly and gaseously sealed canister 32 and first valve 36 having long stem 38 and port 40 located near the bottom of the canister 32. Canister 32 also includes second valve 42 having short stem 44 with port 46 located near the top of canister 32. Canister 32 is illustrated as having a supply of lubricating oil 34. Closed loop calibrated oil augmentation system 100 includes four coupler hoses 60, 64, 66 and 68. First and second coupler hoses 60 and 64 fluidly connect compressor oil drain port valve 22 of non-operating compressor 12 with long stem first valve 36 of canister 32 via clear calibrated fluid injection device 140. Third and fourth coupler hoses 66 and 68 gaseously connect refrigerant drum 112 with short stem valve 42 of canister 32 and pressure port valve 148 of clear calibrated fluid injection device 140.

In operation, the operating technician connects canister 32, non-operating compressor 12, clear calibrated fluid injection device 140, refrigerant drum 112 and first, second, third and fourth coupler hoses 60, 64, 66 and 68 in a fluidly and gaseously sealed manner as disclosed above. By opening refrigerant drum valve 113 and canister second short stem valve 42, pressure is applied to oil 34 by higher pressure refrigerant gas tank 112 via coupler hose 66. Then by opening canister first long stem valve 36, clear calibrated fluid injection device inlet valve 144 and vent valve 146, the clear calibrated fluid injection device will begin to fill with lubricating oil 34 via coupler hose 64 due to the pressure provided to oil in canister 32 from refrigerant drum 112. When the appropriate amount of lubricating oil is contained in or captured by the clear calibrated fluid injection device, the operating technician closes canister first long stem valve 36 and clear calibrated fluid injection device inlet valve 144 and vent valve 146. The operating technician then opens clear calibrated fluid injection device pressure valve 148, outlet valve 147 and compressor oil drain valve 22. Refrigerant drum 112 then supplies pressure via coupler hose 68 to clear calibrated fluid injection device 140 to force the lubricating oil into compressor casing 14. When the appropriate amount of lubricating oil has been injected into compressor casing 14, the calibrated oil augmentation service is terminated and the appropriate valves are closed.

It is important to note that closed loop oil augmentation system 100 is not only a closed fluid loop system but also a closed refrigerant gas loop system by virtue of the containment of the same within the system.

FIG. 7 generally illustrates a cross-sectional view of one type of canister 200 that may be used to contain the compressor lubricating oil. It should be noted that the present invention need not be limited to the particular canister illustrated in FIG. 7. Other type canisters with like physical attributes and which provide the same closed loop characteristics to prohibit the escape of refrigerant gases may be used. Canister 200 generally includes a stainless steel cylindrical container 210 having a molded rubber bottom piece 212 with a peripheral rubber foot 214. A top rubber piece 216 extends above top wall 218 of container 210. Top rubber piece 216 includes a plurality of cut-outs, two of which are cut-outs 220 and 222, which provide handles for operating technicians. The total height of container 210 is approximately 10" to 15". The total circumference of container 210 is approximately 9". As such, the container is highly portable. Container 210 includes short stem quick release valve assembly 230 having outlet port 232 located near top region 234 of the interior of container 210. Quick release valve 236 of short stem valve assembly 230 is located exterior of container 210. In the current embodiment, quick release valve 236 incorporates a bicycle type (schrader) valve. In the preferred embodiment, a ball valve may be used to control the amount of refrigerant gas flowing through any attached coupler hose. Container 210 also includes a long stem quick release valve assembly 240 having inlet/outlet port 242 located near bottom region 244 of the interior of container 210. Quick release valve 246 of long stem valve assembly 240 is located exterior of container 210. In the current embodiment, quick release valve 244 incorporates a bicycle type (schrader) valve.

In the preferred embodiment, a ball valve may be used to control the amount of lubricating oil flowing through any attached coupler hose.

In order to fill canister 210 with, or to empty, lubricating oil, plug type lever lock removable cap 270 is retained on the top of the container. Cap 270 fits into an elliptical cut out formed by raised edge 272 in the top wall 218 of container 210. Cap 270 includes, about its lower periphery, grove or peripheral channel 274 within which is held O-ring gasket 276. This O-ring gasket, when in use, is compressed between interior surface 231 of top wall 218 and peripheral channel 274 formed by the lower peripheral region of cap 270. In order to form an air tight seal between O-ring 276 and interior surface 231 of top wall 218 of container 210, wire type handle 280 is rotatable through a pair of struts, strut 282 and its counterpart, which are affixed to cap 270 and which extend vertically above top surface 284 of cap 270. Wire handle 280 has a pair of legs, leg 292 and its counterpart, which in the closed configuration, transfer downward pressure on exterior surface of top wall 218. Wire handle 280 also includes an operator interface loop 290. This "U" shaped loop 290 is used to apply levering action to lock and unlock cap 270.

FIG. 8 shows a perspective view of cap 270. Similar numerals designate similar items in FIGS. 7 and 8.

The action of closing and securing cap 270 is accomplished by inserting cap 270 into the elliptical opening in top wall 218 and configuring cap 270 in such a manner as to match the boundaries of the elliptical opening formed by raised edge 272 with the inner boundary of peripheral channel 274 of cap 270. The "U" shaped loop 290 of wire handle 280 is then rotated downward in a levering motion which causes leg 292 and its counterpart to bear down onto top wall 218 and generate upward pressure on strut 282 and its counterpart thereby pulling cap 270 upward. This action compresses O-ring gasket 276 firmly against the interior surface 231 of top wall 218 forming an air tight seal. It should be noted that cap 270, by virtue of its plug type design, will act to increase the hermetic seal established by O-ring 276 once the closing action has been completed and container 210 is pressurized.

The action of opening cap 270 is accomplished by applying a levering action upward on handle 280 by way of the "U" shaped loop 290 thus releasing downward pressure exerted on exterior surface of top wall 218 by leg 292 and its counterpart. This action in turn releases the upward pressure exerted by wire handle 280 on strut 282 and its counterpart and onto cap 270, thus releasing the air tight seal created by the compression of O-ring gasket 276 against the interior surface 231 of top wall 218. Cap 270 may then be configured in such a manner to allow its removal through the elliptical opening in top wall 218. Cap 270 also incorporates pressure release device 298 (FIG. 8) which acts to prevent over-pressurization situations within container 210. It should be noted that cap 270, by virtue of its plug type design, will not release its established air tight seal even after the opening action has been completed, until all refrigerant gas pressure within container 210 has been relieved.

Gauges are used to monitor the refrigerant gas pressure on gas lines in these systems. These gauges are not shown in the drawings.

The claims appended hereto are meant to cover modifications and changes within the scope and spirit of the present invention.

What is claimed is:

1. A closed loop calibrated oil system in combination with a non-operating refrigerant compressor, said compressor having lubricating oil therein, a submerged oil drain port, a refrigerant inlet port and refrigerant outlet port, said system includes:

a portable refrigerant tank with outlet port to provide motive force in place of an operating compressor;

a clear calibrated fluid injection device having an inlet port, outlet port, pressure port and vent port;

a first coupler hose fluidly connects said oil drain port to said clear calibrated fluid injection device outlet port, a second coupler hose fluidly connects said clear calibrated fluid injection device inlet port to said first valve, a third coupler hose gaseously connects said second valve to said refrigerant tank outlet port and a fourth coupler hose gaseously connects said clear calibrated fluid injection device pressure port to said refrigerant tank outlet port;

whereby a closed gaseous and fluid loop is established between said compressor, said refrigerant tank, said canister and said calibrated fluid injection device, while said oil is injected, in calibrated amounts, into said compressor.

2. A closed loop oil system in combination with a refrigerant compressor, said compressor having lubricating oil therein, and a submerged oil drain port, the closed oil system comprising:

a portable sealed canister for containment of compressor lubricating oil, said canister having a first and a second valve, said first valve having a stem with submerged fluid port located near a bottom of said canister and said second valve having short stem with a port located near a top of said canister;

a portable contained supply of refrigerant;

a first coupler hose fluidly connecting said first valve and said drain port, and a second coupler gaseously connecting said supply of refrigerant and said second valve.

3. A closed oil system as claimed in claim 2 wherein said canister is a fluidly sealed canister.

4. A closed oil system as claimed in claim 2 wherein said canister is portable.

* * * * *